US006991547B2

(12) United States Patent
Dever et al.

(10) Patent No.: US 6,991,547 B2
(45) Date of Patent: Jan. 31, 2006

(54) ROOF BOLTS FOR USE IN MINES, A METHOD FOR THEIR PRODUCTION AND METHOD FOR THEIR INSTALLATION

(75) Inventors: Kerry Lee Dever, Lexington, KY (US); Peter Shelley Mills, Stamping Ground, KY (US)

(73) Assignee: Minova International Limited, Witan Way Witney (GB)

( * ) Notice: Subject to any disclaimer, the term of this patent is extended or adjusted under 35 U.S.C. 154(b) by 0 days.

(21) Appl. No.: 11/099,600

(22) Filed: Apr. 6, 2005

(65) Prior Publication Data

US 2005/0175417 A1 Aug. 11, 2005

Related U.S. Application Data

(62) Division of application No. 10/488,544, filed as application No. PCT/GB02/04134 on Sep. 11, 2002.

(60) Provisional application No. 60/318,637, filed on Sep. 13, 2001.

(51) Int. Cl.
*B21H 3/02* (2006.01)

(52) U.S. Cl. ..... 470/11; 470/12; 470/47; 470/125; 470/141

(58) Field of Classification Search ..... 470/11, 470/12, 16, 17, 44, 47, 121, 125, 137, 141, 470/144; 700/109, 175; 11/176, 206; 702/33, 702/81, 82; 411/1; 405/259.1
See application file for complete search history.

(56) References Cited

U.S. PATENT DOCUMENTS 4,514,111 A 4/1985 Issakainen
4,557,631 A 12/1985 Donan et al.
4,559,830 A * 12/1985 Plummer et al. ..... 73/761
4,759,888 A * 7/1988 Brest van Kempen ... 405/259.5
4,789,287 A 12/1988 Le
4,828,445 A 5/1989 Giannuzzi
5,078,547 A 1/1992 Calandra et al.
5,154,670 A * 10/1992 Sygnator et al. ..... 470/125
5,195,931 A * 3/1993 Wright et al. ..... 470/40
5,222,835 A 6/1993 Wright
5,688,090 A 11/1997 Miyamoto
6,735,994 B2 * 5/2004 Buhler et al. ..... 72/20.1
2003/0210967 A1 11/2003 Mills

FOREIGN PATENT DOCUMENTS

DE 32 19 356 12/1983
DE 3643522 6/1988

* cited by examiner

*Primary Examiner*—Ed Tolan
(74) *Attorney, Agent, or Firm*—Nixon & Vanderhye, P.C.

(57) ABSTRACT

A roof bolt comprises a shaft for insertion in a hole drilled in a mine roof and a head whereby the bolt may be rotated, the head being offset with respect to the longitudinal axis of the shaft so that when the bolt is rotated by means of its head the shaft is caused to describe a circle of greater diameter than its own diameter, and where the offset is at least 08 inch and not more than 0.25 inch. Preferably the offset is from 0.10 to 0.16 inch. The invention includes a method for the production of roof bolts which comprise a shaft for insertion in a hole drilled in a mine roof and a head whereby the bolt may be rotated, the method being characterised by being controlled so that at least 90% of the bolts produced have their head central axis offset with respect to the longitudinal axis of the shaft by an amount of at least about 0.08 inch and not more than about 0.25 inch.

3 Claims, 6 Drawing Sheets

Figure 1: (a) Placement of slug in open die case.
(b) Closing of moveable die half to grip slug; advancement of punch to upset extended end of slug.

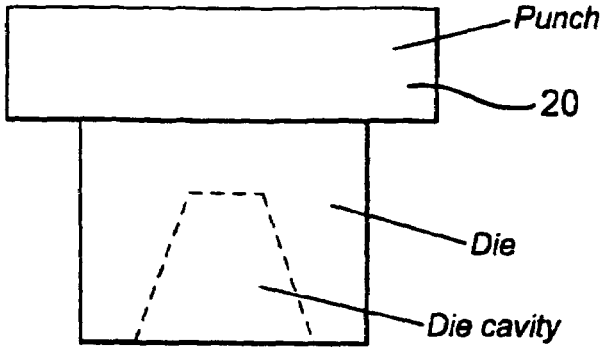
Fig.2
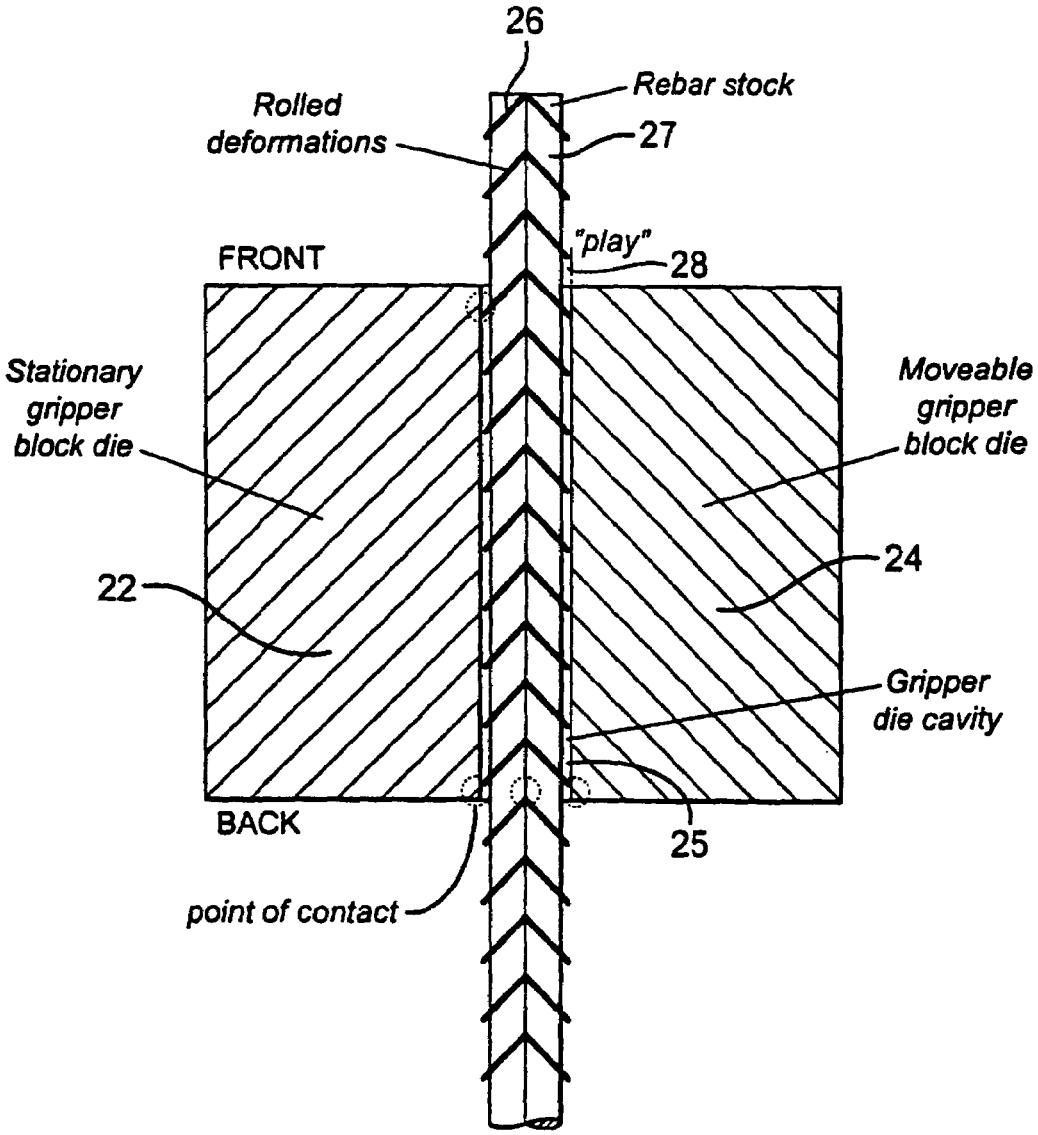
Figure 2: Non-uniform gripping of rebar stock by gripper block dies (cutaway view).

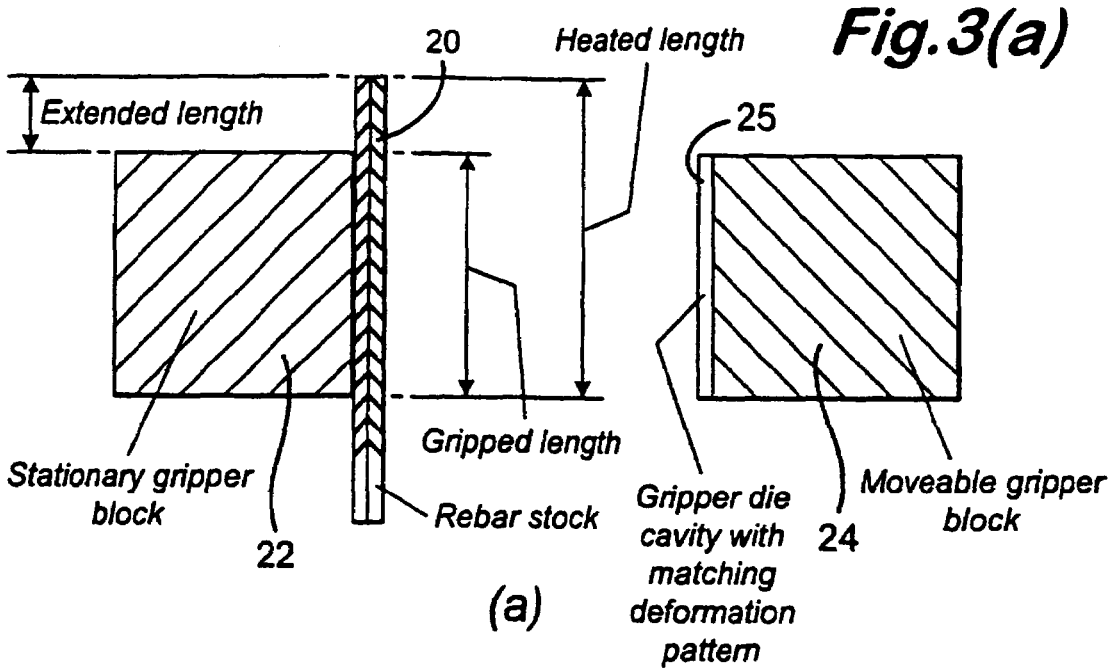
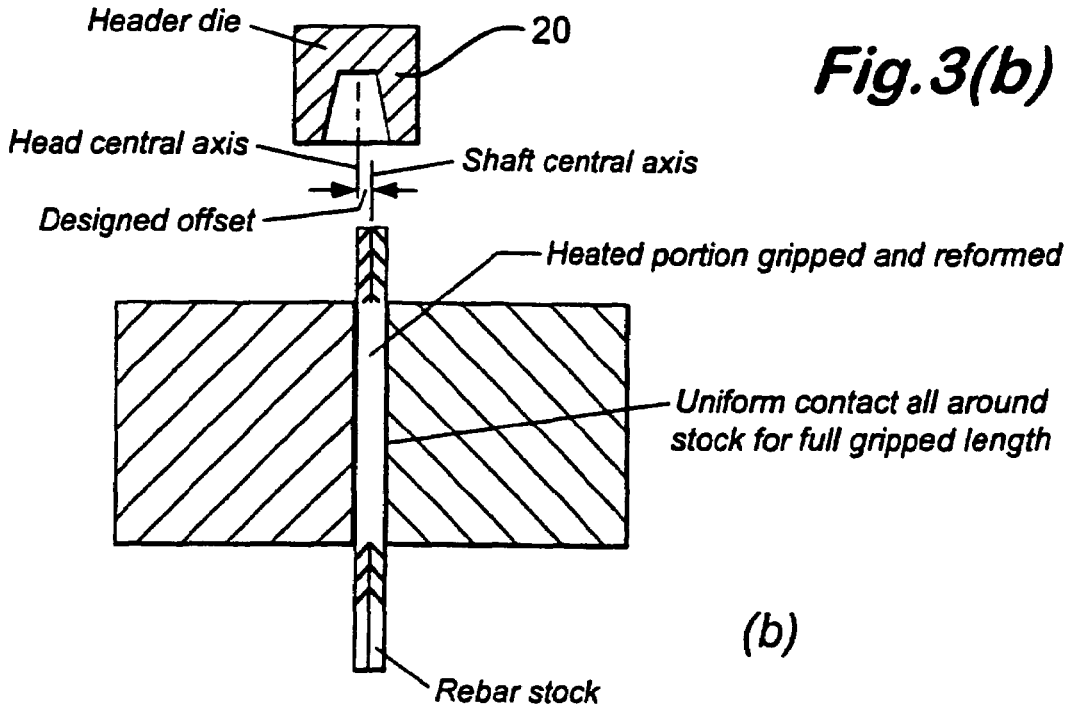
Figure 3: (a) Heated length = extended length + gripped length.
(b) Elimination of system "play" with simultaneous grip and heated re-form; designed offset in header die.

Fig.4
Method of offset measurement.
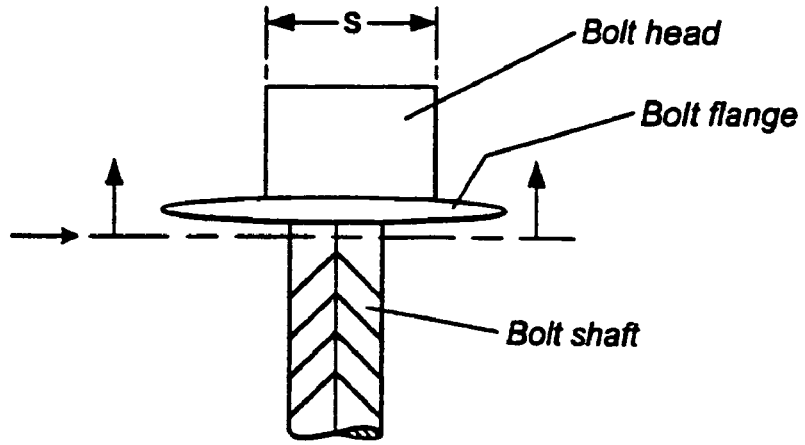
4(i)
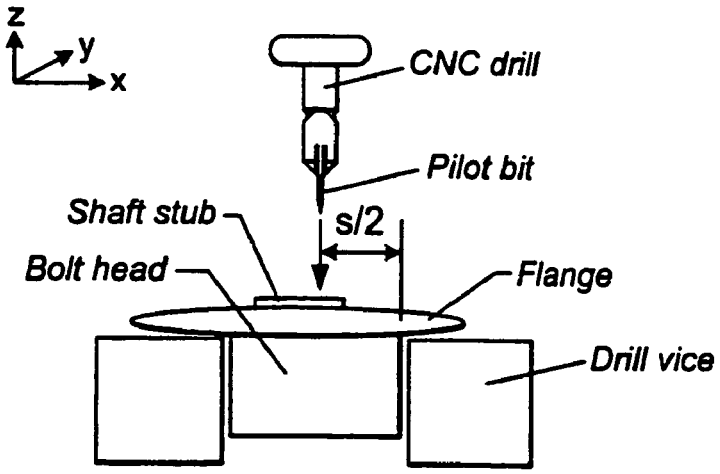
4(ii)
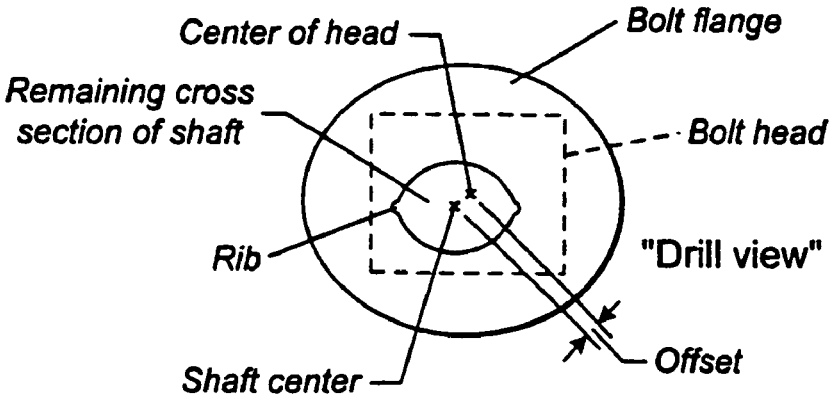
4(iii)

Conceptual schematic of the eclipse roof bolt chuck adapter.

Figure 5: (a) Typical co-axial alignment of system components.
(b) Offset between bolt and hole central axes created by the Eclipse chuck adapter (offset incorporated at plane "Z").

Eclipse head-centered roof bolt.

ROOF BOLTS FOR USE IN MINES, A METHOD FOR THEIR PRODUCTION AND METHOD FOR THEIR INSTALLATION

This application is a division of application Ser. No. 10/488,544, filed Mar. 4, 2004, which in turn was the US national phase of international application PCT/GB02/04134 filed Sep. 11, 2002 which designated the U.S. and further claimed priority benefit of U.S. provisional application Ser. No. 60/318,637, dated Sep. 13, 2001, the entire content of each of which is hereby incorporated by reference.

FIELD OF THE INVENTION

This invention relates to equipment for use in mines, more particularly to roof bolts, to a method for their production and to a method for their installation.

BACKGROUND OF THE INVENTION

Roof bolts are well known in the mining industry and are extensively employed for consolidating the roof and providing anchoring points and support.

Their use involves drilling a hole in the roof of the mine and inserting into the hole a resin filled cartridge. The resin filled cartridges are also well known and comprise a curable resin and a catalyst for the resin contained in a sausage-like skin. In the next step of the installation a bolt is inserted which pierces the skin and penetrates the resin. The bolt is then usually spun about its axis to mix the resin and catalyst and, once mixed, the resin cures and sets.

In some mines it is the normal practice to apply tension to the bolt after the resin has set. This may be done by providing a screw threaded portion on the bolt and screwing a nut onto the threaded portion to abut an end plate until a certain predetermined torque is reached, which is normally 120 to 150 ft lbs. This results in tension between the bolt and the end plate.

PROBLEM TO BE SOLVED BY THE INVENTION

There is a long standing problem in coal mining particularly when employing small diameter bolts, of a phenomenon which is called glove fingering.

The problem arises when the bolt is inserted into the hole. Insertion of the bolt causes pressure on the cartridge which forces the skin to the hole wall. The bolt then bores a hole through the contents of the cartridge leaving the skin substantially intact. The result is incomplete direct contact by the resin with the wall of the hole and hence a less than optimum anchorage.

In mining operations in the USA there is widespread use of roof bolts which are about ⅝ (five eighths) of an inch in diameter and these bolts are routinely employed in holes which are about 1 (one) inch in diameter. Another frequently used combination is a ⅞ (seven eighths) inch diameter bolt in a 1 (one) and ⅜ (three eighths) diameter hole. Glove fingering is a problem frequently encountered with these combinations of sizes of bolt and hole.

Previous attempts to solve the problem have involved the use of a thinner skin to contain the resin, coarse filler in the cartridge and slash cut bolts. However these have generally achieved only limited success.

The present invention provides an alternative solution to the problem by causing the bolt, when it is rotated or spun by means of its head, to describe a circle of diameter greater then its own diameter.

One embodiment of the invention provides a novel form of roof bolt in which the head of the bolt is offset with respect to the axis of its shaft by at least 0.08 inches.

SUMMARY OF THE INVENTION

According to the present invention there is provided a roof bolt comprising a shaft for insertion in a hole drilled in a mine roof and a head whereby the bolt may be rotated and wherein the head is offset with respect to the longitudinal axis of the shaft so that when the bolt is rotated by means of its head the bolt is caused to describe a circle of greater diameter than its own diameter, the amount of said offset being from 0.08 to 0.25 inches.

The offset is preferably from about 0.10 to about 0.16 inches.

ADVANTAGEOUS EFFECT OF THE INVENTION

The effect of the offset is that when a bolt is rotated by means of its head, the shaft is caused to rotate about an axis which is offset with respect to its longitudinal axis and describe a circle of diameter greater than its own diameter.

The result is to rupture the skin of the cartridge more effectively and thereby improve the contact of the resin with the wall of the hole. In addition mixing of the cartridge resin and catalyst contents is improved resulting in an improved anchorage.

BRIEF DESCRIPTION OF THE DRAWINGS

FIG. 4 is a schematic drawing which shows three steps in the measurement of the offset.

FIG. 5(*a*) the conventional procedure where the axis of the roof bolt shaft is in alignment with the axis of the hole and FIG. 5(*b*) employing a novel chuck adapter which creates an offset between the two axes.

DETAILED DESCRIPTION OF THE INVENTION

Figure 1A:
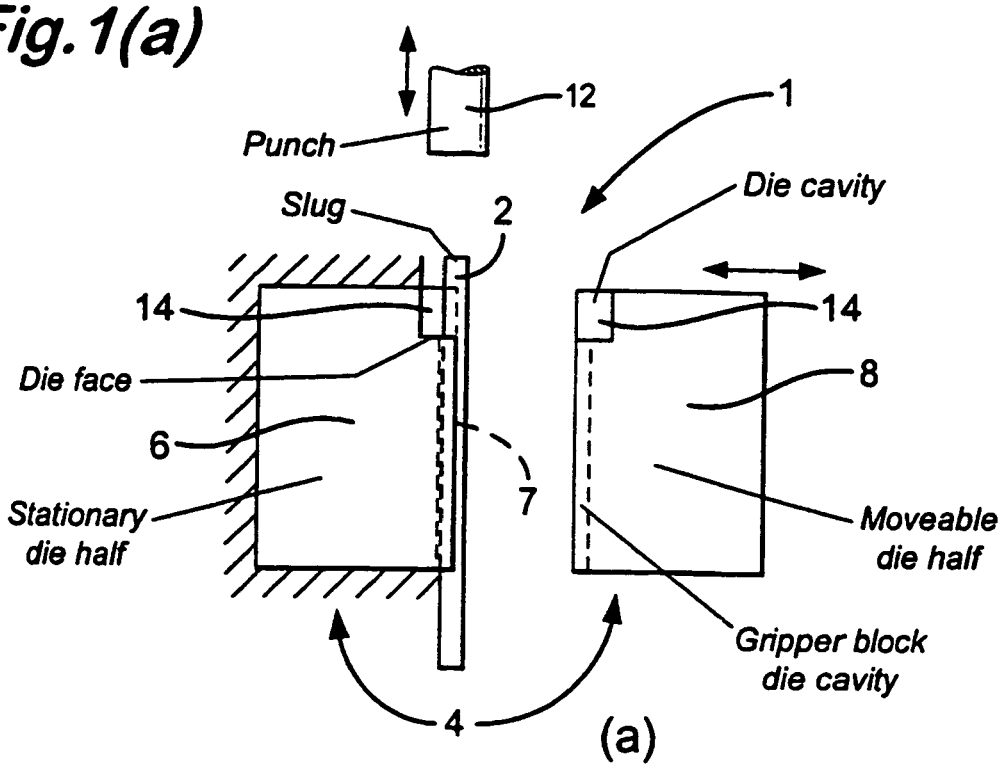
FIG. 1(*a*) to FIG. 3(*b*) are longitudinal sections, not all drawn to the same scale, showing the two halves of the gripper block die and the header die at different stages of the production of the roof bolt.

It has been observed that a small proportion of roof bolts which are currently available commercially have their head offset with respect to their shaft. It is understood that this offset is accidental and arises merely on account of the engineering tolerances employed in their manufacture. Careful measurement of a large number of currently available roof bolts has established that the amount of offset is never greater than 0.07 inches. Bolts whose offset is 0.07 inches only exhibit a marginal effect on the problem of glove fingering. Such bolts are not suitable for use in the present invention with a conventional drill chuck although they may be used with the novel chuck adapter described in the present specification.

The term roof is intended to embrace all surfaces of a mine such as wall and floor as well as overhead surfaces.

The term mine is intended to include all earthworks requiring support including quarries including tunnels.

References to the head being offset refer to the central axis of the head. When the head is held in a conventional drill chuck and rotated in conventional manner, the head is rotated about its central axis. The degree of offset is measured by the method described in the present specification.

According to one embodiment the roof bolt includes a wobble inducing means such as a laterally projecting member attached to the shaft, preferably in the region of the end of the shaft distant from the head.

The laterally projecting member may be in the form of a stub and is preferably located at, or close to, the end of the shaft of the bolt.

The laterally projecting member may be welded to the shaft or attached by other means such as glueing. The laterally projecting member may also be integral with the shaft i.e formed in one piece with the shaft or formed from the shaft.

The rigidity and length of the laterally projecting member or stub is such that on rotating the bolt by means of the head it will maintain the bolt tip in an offset position (ie push the end of the bolt to one side of the hole) and thereby assist. disintegration of the skin of the capsule and result in a good bond between the resin and the wall of the hole.

Typically the stub will project about 0.0625 to about 0.625 inches laterally from the shaft. The length of the stub (the amount it projects laterally from the shaft) is not more than the hole diameter minus the bolt diameter and will usually be about 50 to 80% of the difference between the hole diameter and the bolt diameter.

The stub is preferably located so that it is opposed, more preferably diametrically opposed, to the offset in the head.

It has been found experimentally that the laterally projecting member or stub when used on a conventional roof bolt i.e. one not having an offset can effect a reduction in glove fingering.

Thus, according to another aspect of the present invention there is provided a roof bolt comprising a shaft for insertion in a hole and a head whereby the bolt may be rotated and where there is located at a position on the shaft spaced from the head a laterally projecting member having sufficient length and rigidity to cause wobble when the shaft is rotated.

The laterally projecting member may be provided by a stub as described above. According to another aspect of the present invention there is provided a method for the production of roof bolts said roof bolts comprising a shaft for insertion in a hole drilled in a mine roof and a head whereby the bolt may be rotated, wherein the method is controlled so that at least 90%, preferably at least 95%, of the bolts produced have their head offset with respect to the longitudinal axis of the shaft by an amount of at least about 0.08 inches and not more than about 0.25 inches, preferably from about 0.10 to about 0.16 inches.

The method may comprise forming the bolts from lengths of steel rod by forging in a header machine said header machine comprising a gripper die and a header die, the method further including accurately centering the rod in the gripper die and forming the head by employing a header die incorporating the offset in the construction of the header die.

The method preferably comprises centering the rod in the gripper die by heating the end to be headed to a length equivalent to the extended length calculated to fill the die plus the length of the gripper die block.

Conventional roof bolts, if they have any offset at all, always have an offset of less than 0.07 inches and the present invention provides a system that enables conventional roof bolts to be used in a manner that reduces glove fingering. The system employs a novel chuck which is adapted to rotate the bolt so that the shaft is rotated about an axis which is offset from its own axis.

Thus according to a further aspect of the present invention a system for roof bolting comprises means for holding and rotating a roof bolt, said means including a chuck for holding the head of the roof bolt and wherein the chuck is adapted to rotate the bolt so that its shaft rotates about an axis which is offset with respect to the axis of the shaft whereby the shaft is caused to describe a circle of diameter greater than its own diameter.

Preferably the chuck is adapted so that the offset is from about 0.08 to about 0.25 inches.

According to another aspect of the invention a method for the installation of a roof bolt comprises:

inserting the roof bolt into a drilled hole containing a cartridge comprising a curable resin and catalyst therefor so that the bolt penetrates the curable resin and rotating the bolt by means of its head to mix the resin and catalyst to effect curing of the resin and where the axis of rotation of the bolt is offset with respect to the longitudinal axis of the shaft so that the shaft is caused to describe a circle of diameter greater than its own diameter.

Roof bolt heads are conventionally formed by a process called upset forging which is a process which increases the diameter of the end or central portion of a bar of metal by compressing its length. The bolts are made in a machine called an upsetter which consists of an electric motor/flywheel arrangement which powers a slider-crank mechanism. The latter actuates a piston punch delivering a blow, and upsetting, the end of a slug.

Figure 1B:
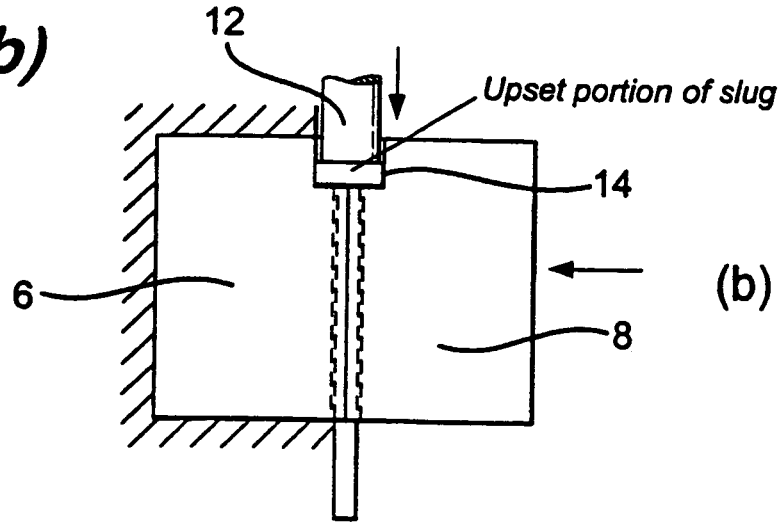

Referring to FIGS. 1*a* and 1*b*: a slug 2 which is a precut length of rod stock is loaded, usually automatically, into an upsetter machine indicated generally by numeral 1. The slug 2 is gripped within a two part die set 4 featuring a stationary die half 6 and a moveable die half 8. With the die 4 in the open position (moveable half 8 slid out away from the stationary half 6) the slug 2 is placed in the gripper block die cavity 7 of the stationary half 6 with a prescribed length sufficient to fill the cavity extending out from the die face (usually by means of a stop plate). The moveable half 8 slides inward gripping the slug 2 as the punch 12 advances and imparts a particular plastic deformation in, or upsets, the slug material 2, causing it to flow to fill the die cavity 14 (FIG. 1(*b*)). The die 4 then reopens while a finger mechanism (not shown) engages the finished part and ejects it from the die.

Upsetter forging machines used solely for the purpose of placing heads on bolts are referred to as headers. Referring to FIG. 2: these are most often three stroke (cycle) with a 3 stage die set affixed to a header die and punch 20 and the slug 27 gripped between two gripping block die halves 22 and 24. Such machines are used to form heads on rebar in the manufacture of roof bolts for the underground mining and tunnelling industry.

Although the punch/die tool alignment with the gripping block die cavity 25 is extremely precise, a slight variance exists in the manner in which the rebar stock 27 is gripped by the die blocks 22 and 24, resulting in a slight offset (typically less than $1/16^{th}$ (one sixteenth) inch between the rod or shaft axis and that of the formed head. This is due in large part to the inability of the gripper die cavity 25 (designed to accommodate round bar stock of uniform diameter) to evenly contact the non-uniform rolled deformations 26 of the rebar 27. Since the maximum diameter of rebar stock 27 may vary from 0.010 to 0.015 inches between any two axial points, a high probability exists that the extent of effective grippable surface area of the rebar 27 contacted by the gripper die at its front face differs from that at the back, thus allowing play 28 or room for swing at either end (see FIG. 2). Should the effective grip area be equivalent at the gripper block extremes, it is still probable that some points of contact between the internal surface of the gripper block die cavity 25 and the rebar 27 at the front face of the gripper die block are diametrically opposed to those at the back, allowing swing at either end. Hence upon contact with the punch 20, an offset is produced between the shaft axis and that of the formed head. Again, the given magnitude of play in the gripper die results in an offset typically less than 1/16 (one sixteenth) inch.

In a preferred embodiment of the present invention the rebar stock is accurately centred in the gripping die prior to punch advancement and the required degree of offset in the bolt is incorporated into the design of the header die.

As stated above the amount of offset should be from about 0.08 inch to about 0.25 inch. Preferably the amount of offset is from about 0.10 inch to about 0.16 of an inch.

One method of initially centering the stock 27 in the gripping die 22, 24 is to heat the end 20 to be headed to a length equivalent to the extended length calculated to fill the header die plus the length of the gripper die block 22, 24. (FIG. 3*a*). Then using a gripper block with a die cavity containing impressions of an approved or matching rebar deformation pattern, the gripping pressure can be adjusted to reform the gripped portion of heated rebar.

This enables the gripper blocks to simultaneously grip and form the stock, resulting in the elimination of play in the system (FIG. 3*b*). The header die 20 can then incorporate the required degree of offset.

When the production is controlled in accordance with the present invention at least 90%, preferably at least 95% of the bolts have the required degree of offset.

The roof bolt conveniently includes a flange to abut a plate of the type conventionally used with roof bolts. Such a plate is known in the art as a roof plate, and is conventionally used to abut the surface of the roof. The plate can be conveniently mounted on the bolt and movable along the length of the bolt. The purpose of the plate is to spread the load and provide a firm seat for the head of the bolt.

In the installation of a roof bolt according to the invention a hole can be drilled in the roof and a frangible cartridge containing a curable resin and catalyst inserted into the hole in a manner that is known in the art. The bolt of the present invention can then be inserted into the hole and rotated to mix the resin and catalyst.

The invention is illustrated by the following Example.

EXAMPLE

Test bolts were made by modifying standard 4 feet by 5/8 inch diameter headed bolts.

The heads were cut off the bolts and a hole drilled in them offset by 0.125 (1/8) inch from the center. One end of the bolts was threaded and the hole in the bolt head tapped to accept the bolt. Bolt and head were tightly attached.

A four feet long resin cartridge was placed inside a four feet long steel tube. The tube was sealed at one end representing a bore hole in a mine roof. A modified bolt was inserted fully and spun for three seconds in accordance with established mine practice.

Once the resin was hard the tube was split and the contents examined for glove fingering. The experiment was repeated three times with the same type of modified bolt. The results are summarised in the Table.

| Test Number | Glove fingering (% of grouted area) |
|---|---|
| 1 | 0.9% |
| 2 | 4.9% |
| 3 | 6.9% |
| 4 | 24% |

Tests with the conventional i.e. non offset bolts of the same diameter showed glove fingering ranging from 55 to 100%.

% glove fingering is equal to the glove fingered area divided by the total surface area of the resin column.

In addition the resin and catalyst were mixed more effectively with the offset bolts.

Measurement of Offset.

FIG. 4 illustrates an accurate method of measuring the offset The method has been developed to eliminate error due to any angle that may exist between the flange and shaft (i.e. the case where the shaft is not normal to the flange). Such an angle would tend to lead to erroneously high values of offset.

Referring to FIG. 4:

(i) using a cut-off saw or band saw, the shaft is cut through just below the flange, so as to leave a small projection or stub of shaft approximately $1/16^{th}$ to $1/8^{th}$ inch high see 4(i). The width, s of the bolt head is measured using a micrometer calliper.

(ii) the bolt head is inverted and mounted in the work piece vice of the CNC drill press machine see 4(ii). The drill is programmed to auto-adjust to locate a point at a distance is of s/2 from the vice in both the "x" and "y" directions. A pilot hole is drilled to a depth of $1/16^{th}$ inch or so to locate the center of the bolt head.

(iii) using a micrometer calliper, the center of the shaft projection is located and marked.

Similarly the distance between the head and shaft centers is measured as the bolt offset see 4(iii). Referring to FIGS. 5(*a*) and 5(*b*): a typical bolting cycle consists of (i) drilling a bore hole 40(ii) lowering the drill boom to retract the drill bit (or drill steel as it is commonly referred to in the industry), (iii) placement of the roof bolt chuck adapter 42 in the bolter drill chuck (iv) manually inserting the cartridge(s) (not shown) in the hole (v) manual advancement of the bolt tip 44 of roof bolt 41 into the hole 40 to retain the cartridge(s) (vi) placement of the head of the roof bolt 41 in the chuck adapter 42 (with roof plate (not shown) previously installed on the bolt) (vii) hydraulically raising the drill boom to fully insert the bolt 41 into the hole 40 and (viii) hydraulically actuating the bolter drill head to spin the bolt 41 to mix the resin.

Figures 5A, 5B:
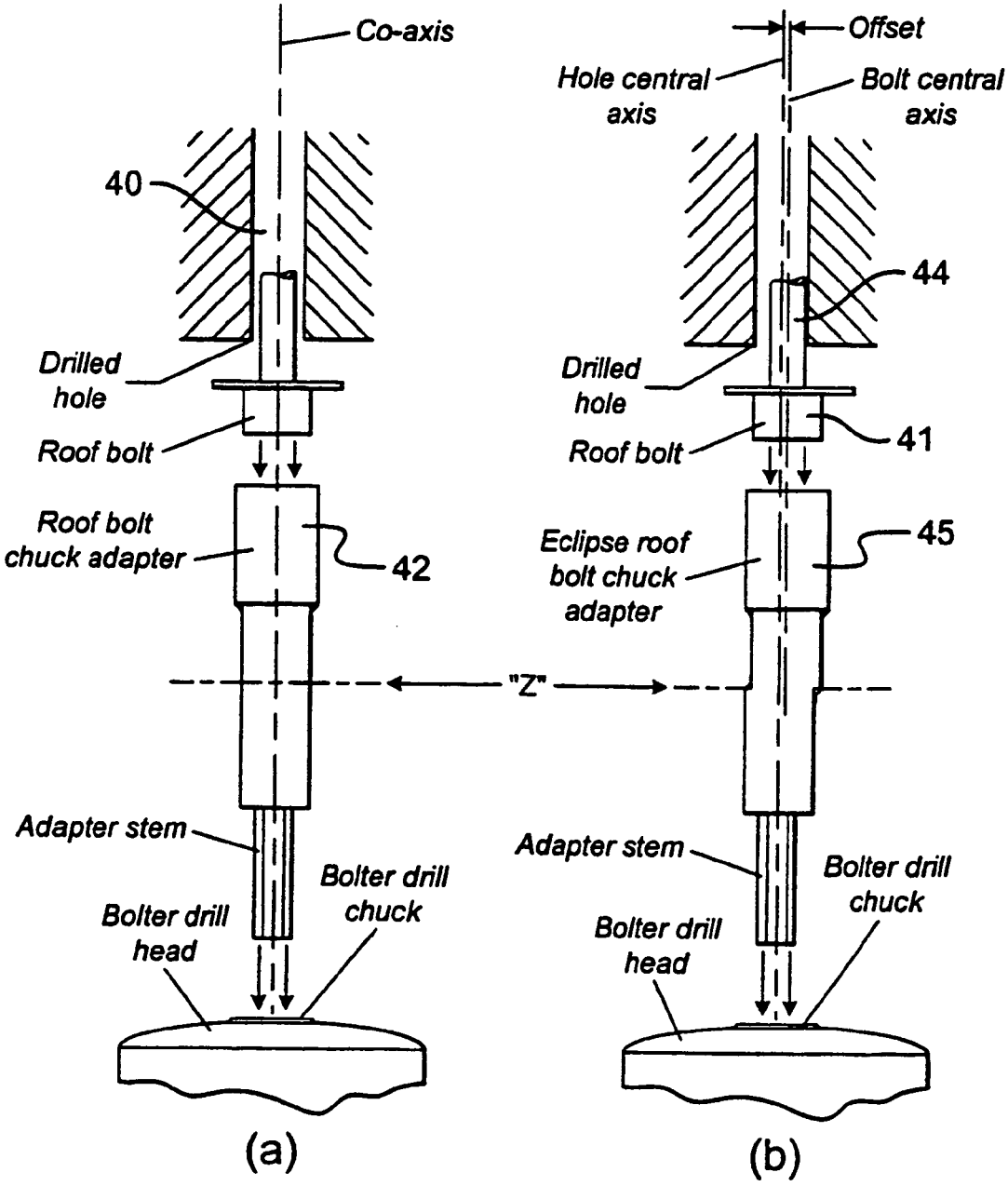
FIGS. 5(*a*) and 5(*b*) show the installation of a roof bolt.

Upon lowering the boom (step ii), the bolter drill chuck and bore hole should remain coaxial so that subsequent placement of the roof bolt chuck adapter and roof bolt ensures that all components of the system remain coaxial as well (refer to FIG. 5*a*).

However where a $5/8^{th}$ inch bolt is inserted into a 1 inch hole, a 3/8 inch total annulus results. This annulus is considered large for a 1 inch hole and has been shown to significantly contribute to the problem of glove fingering, where the size of the annulus allows the bolt to bore through the central portion of the cartridge, leaving the cartridge film or skin intact between the resin contents of the cartridge and the hole wall.

Subsequent spinning of the bolt is often ineffective in shredding the film as the large annulus prevents the generation of a shear stress between the bolt surface and the film sufficient to pull the film away from the hole wall to be shredded.

In FIG. 5(*b*) there is shown a novel chuck adapter 45 which provides an offset between the axes of the hole/drill and the bolt 44 such that the former remains the axis of rotation, allowing a point on the outermost surface of the bolt to generate a circle of greater diameter than the bolt itself (diameter=bolt diameter+2× offset). This effectively decreases the annulus by twice the offset, thereby increasing mixing shear and improving the shredding of the film. This offset is shown diagrammatically as a shift in axis in plane "Z". This purely radial shift may be physically accomplished by cutting a typical adapter at "Z" perpendicular to its axis at some arbitrary distance from an end, and welding the portions back together at an offset in the radial direction.

However, the offset may be achieved by various machining and manufacturing methods, utilizing a greater axial length of the adapter, so long as a resultant prescribed offset exists between the hole and the bolt axes.

Possible methods of manufacturing the adapter include forging, casting, multistage turning and cold working.

Figure 6:
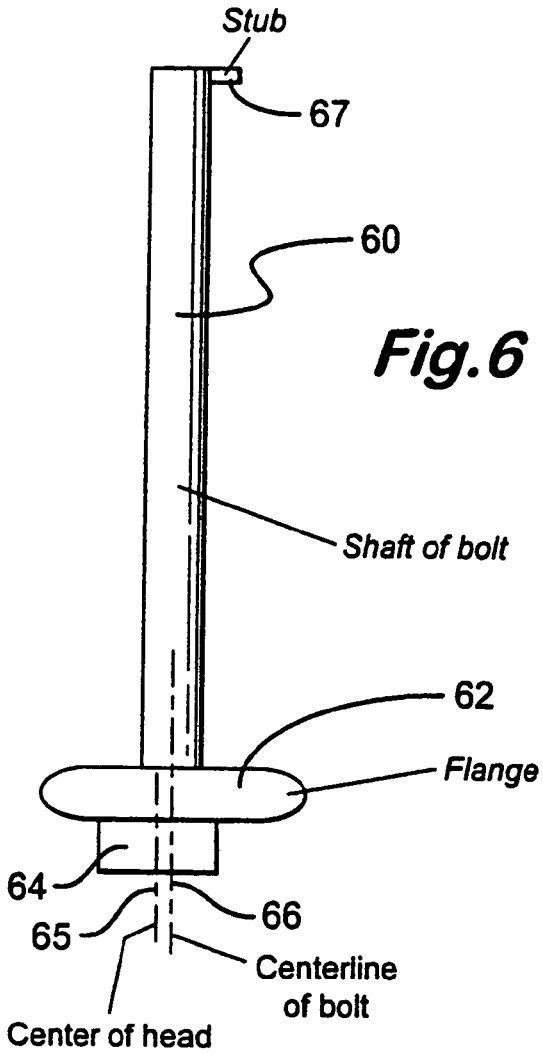
FIG. 6 is a side view of a bolt having an offset head and further including a wobble inducing member located on its shaft and FIG. 7 is a side view of a bolt whose head is not offset including a wobble inducing member located on its shaft.

Referring to FIG. 6 which is a side view not to scale of a bolt which comprises a shaft 60 and flange 62 and a head 64 by means of which the bolt may be rotated. The central axis 65 of the head is offset with respect to the axis 66 of the shaft and the bolt also includes at the tip of the shaft a stub 67 having sufficient length and rigidity to induce wobble in the rotation of the bolt. The stub 67 is a short projecting piece of steel welded to the shaft 60. The stub 67 is about 0.3125 inches in length and is attached at right angles to the shaft 60 in the same plane and diametrically opposed to the offset in the head 64. The length of the shaft of the bolt is 8 feet.

When the bolt is rotated by means of its head 64 the effect of the stub 67 and the offset of the head is to cause a double cone wobble. In the case of long roof bolts (typically greater than 5 feet in length and especially greater than 6 feet or 8 feet) this is particularly effective in causing disintegration of the skin of the capsule and thereby assists bonding of the resin with the wall of the hole.

Figure 7:
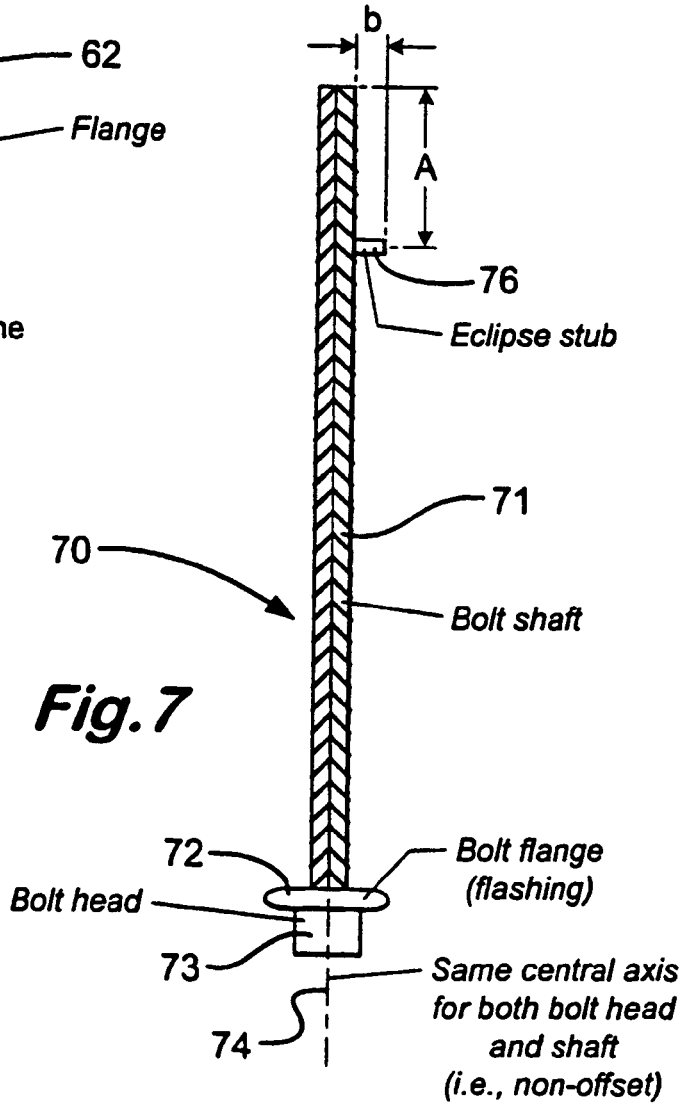

Referring to FIG. 7 a bolt 70 comprises a shaft 71 and flange 72 and head 73 by means of which the bolt is rotated. The central axis 74 of the head 73 is in alignment with the axis of the shaft 71. Located on the shaft 71 at a position remote from the head 73 is a laterally projecting member in the form of a stub 76 of steel welded to the shaft and having sufficient length and rigidity to induce wobble in the rotation of the shaft.

The invention claimed is:

1. A method for the production of roof bolts said roof bolts comprising a shaft for insertion in a hole drilled in a mine roof and a head whereby the bolt may be rotated, the method being characterised by being controlled so that at least 90% of the bolts produced have their head offset with respect to the longitudinal axis of the shaft by an amount of at least about 0.08 inches and not more than about 0.25 inches.

2. A method as claimed in claim 1 which method comprises forming the bolts from lengths of steel rod by forging in a header machine said header machine comprising a gripper die and a header die, the method further including accurately centering the rod in the gripper die and forming the head by employing a header die incorporating the offset in the construction of the header die.

3. A method as claimed in claim 2 which comprises centering the rod in the gripper die by heating the end to be headed to a length equivalent to the extended length calculated to fill the header die plus the length of the gripper die block.

* * * * *